US008430655B2

(12) United States Patent
Kobayashi et al.

(10) Patent No.: US 8,430,655 B2
(45) Date of Patent: Apr. 30, 2013

(54) HIGH-PRESSURE PUMP

(75) Inventors: Masayuki Kobayashi, Kasugai (JP); Tatsumi Ogari, Okazaki (JP); Hiroshi Inoue, Anjo (JP)

(73) Assignee: Denso Corporation, Kariya (JP)

( * ) Notice: Subject to any disclaimer, the term of this patent is extended or adjusted under 35 U.S.C. 154(b) by 230 days.

(21) Appl. No.: 12/841,424

(22) Filed: Jul. 22, 2010

(65) Prior Publication Data

US 2011/0110807 A1 May 12, 2011

(30) Foreign Application Priority Data

Nov. 9, 2009 (JP) ..... 2009-256382

(51) Int. Cl.
*F04B 11/00* (2006.01)

(52) U.S. Cl.
USPC ..... 417/540

(58) Field of Classification Search ..... 417/540
See application file for complete search history.

(56) References Cited

U.S. PATENT DOCUMENTS

| | | | | |
|---|---|---|---|---|
| 5,975,061 | A * | 11/1999 | Briggs et al. | 123/514 |
| 6,209,525 | B1 * | 4/2001 | Konishi et al. | 123/467 |
| 6,755,625 | B2 * | 6/2004 | Breeden | 417/298 |
| 6,769,414 | B2 * | 8/2004 | Rembold et al. | 123/514 |
| 2003/0062085 | A1 * | 4/2003 | Onishi et al. | 137/508 |
| 2003/0164161 | A1 * | 9/2003 | Usui et al. | 123/510 |
| 2003/0219346 | A1 * | 11/2003 | Abe et al. | 417/307 |
| 2005/0019188 | A1 * | 1/2005 | Usui et al. | 417/540 |
| 2006/0159555 | A1 * | 7/2006 | Inoue | 417/297 |
| 2008/0175735 | A1 * | 7/2008 | Lucas et al. | 417/540 |
| 2008/0289713 | A1 * | 11/2008 | Munakata et al. | 138/26 |
| 2009/0288639 | A1 * | 11/2009 | Usui et al. | 123/457 |

FOREIGN PATENT DOCUMENTS

| | | |
|---|---|---|
| JP | 2004-138071 | 5/2004 |
| JP | P2006-200407 A | 8/2006 |
| JP | P4036153 | 11/2007 |
| JP | 2008-525713 | 7/2008 |
| JP | P2008-286144 A | 11/2008 |

OTHER PUBLICATIONS

Japanese Office Action dated Jan. 4, 2011, issued in corresponding Japanese Application No. 2009-256382 with English Translation.

* cited by examiner

*Primary Examiner* — Charles Freay
*Assistant Examiner* — Alexander Comley
(74) *Attorney, Agent, or Firm* — Nixon & Vanderhye P.C.

(57) ABSTRACT

A fuel gallery has an inlet opening through which a fuel is introduced therein and a suction opening through which the fuel flows between the fuel gallery and a compression chamber. A pulsation damper is supported in the fuel gallery by a first and a second supporting member. The second supporting member defines an inner fuel chamber and outer fuel chamber which communicates with each other through apertures. The suction opening is located at a side wall of the fuel gallery and the inlet opening is located at a bottom wall of the inner fuel chamber which is defined radially inside of the second supporting member. The fuel discharged into the outer fuel chamber through the suction opening is introduced into the inner fuel chamber through the apertures. A flow velocity of the fuel is decreased and a pressure pulsation reduction effect of the pulsation damper is surely achieved.

5 Claims, 10 Drawing Sheets

HIGH-PRESSURE PUMP

CROSS-REFERENCE TO RELATED APPLICATION

This application is based on Japanese Patent Applications No. 2009-34772 filed on Feb. 18, 2009, and No. 2009-256382 filed on Nov. 9, 2009, the disclosures of which are incorporated herein by reference.

FIELD OF THE INVENTION

The present invention relates to a high-pressure pump used for an internal combustion engine.

BACKGROUND OF THE INVENTION

Conventionally, a fuel supply system which supplies fuel to an engine is equipped with a high-pressure pump. The high-pressure pump is generally provided with a plunger which reciprocates along a camshaft. When the plunger slides down from its top dead center to its bottom dead center, a fuel in a fuel gallery is suctioned into a compression chamber (suction stroke). When the plunger slides up from the bottom dead center to the top dead center, a part of the low-pressure fuel is returned to the fuel gallery (metering stroke). Then, after a suction valve is closed, when the plunger further slides up, the fuel in the compression chamber is compressed (compression stroke).

Generally, the fuel is supplied to the fuel gallery through an inlet and a supply quantity of the fuel depends on a pump performance of a low-pressure pump disposed upstream of the high-pressure pump. When the engine speed increases and the rotational speed of the camshaft is increased, the plunger of the high-pressure pump reciprocates at high speed. It is likely that the fuel supplied through the inlet does not fill the compression chamber enough in the suction stroke. In order to solve such a problem, JP-2006-200407A (US-2006-0159555A1) and JP-2008-525713A, for example, show a high-pressure pump which performs a pumping function to discharge the fuel into the fuel gallery even while the plunger slides down from the top dead center to the bottom dead center.

Besides, in the metering stroke, a pressure pulsation arises due to a low-pressure fuel discharged from the compression chamber to the fuel gallery. Japanese patent No. 4036153 (US-2005-0019188A1) and JP-2008-286144A (US-2008-0289713A1), for example, show a high-pressure pump provided with a pulsation damper in the fuel gallery to reduce the pressure pulsation in the fuel gallery. In the high-pressure pump shown in Japanese patent No. 4036153 (US-2005-0019188A1), a space defined between one surface of a pulsation damper and a bottom wall surface of a housing communicates with an inlet and a compression chamber. In the high-pressure pump shown in JP-2008-286144A (US-2008-0289713A1), a space defined between a support plate supporting a pulsation damper and a bottom wall surface of a housing communicates with an inlet and a compression chamber.

However, in the high-pressure pump shown in JP-2006-200407A and JP-2008-525713A, since the fuel flow in the fuel gallery is not considered, the above pumping function of the plunger is not effectively achieved, so that the suction quantity of the fuel into the compression chamber may be insufficient. Further, in the metering stroke, since a flow velocity of the low pressure fuel discharged from the compression chamber into the fuel gallery is very fast, it is likely that the pressure pulsation is not attenuated sufficiently by the pulsation damper and the fuel leaks from an inlet to a low-pressure fuel pipe in the high-pressure pump disclosed in Japanese patent No. 4036153.

In the high-pressure pump disclosed in JP-2008-286144A, the low-pressure fuel discharged from the compression chamber into the fuel gallery collides with a supporting member of the pulsation damper, so that a flow direction of the fuel is changed transversely. It is likely that the pressure pulsation is not attenuated sufficiently by the pulsation damper and the fuel leaks from an inlet to a low-pressure fuel pipe. When the pressure pulsation is transmitted to the low-pressure fuel pipe, the low-pressure fuel pipe may be vibrated to generate a noise from a fixing member which supports the low-pressure fuel pipe. Such a vibration may be transmitted to a vehicle body through the fixing member. Also, it is likely that the fixing member itself may be damaged.

SUMMARY OF THE INVENTION

The present invention is made in view of the above matters, and it is an object of the present invention to provide a high-pressure pump which is capable of restricting a pressure pulsation due to a fuel discharged from a compression chamber. Also, it is another object of the present invention to provide a high-pressure pump which is capable of suctioning the fuel efficiently by a plunger.

According to the present invention, a high-pressure pump has a fuel gallery in which the fuel is stored. The fuel gallery has an inlet opening through which the fuel is introduced thereinto and a suction opening which communicates with a compression chamber. When a volume of the compression chamber is increased by a plunger, a part of the fuel in the compression chamber is discharged into the fuel gallery through the inlet opening. A pulsation damper is supported in the fuel gallery by a first and a second supporting member. The second supporting member is annularly shaped to define an inner fuel chamber and an outer fuel chamber in its radial direction. The inner fuel chamber and the outer fuel chamber communicate with each other through a restriction provided in the second supporting member. One of the inlet opening and the suction opening is located to confront the outer fuel chamber, and the other is located to confront the inner fuel chamber. When the fuel discharged from the suction opening flows between the inner fuel chamber and the outer fuel chamber, its flow velocity is decreased by the restriction. Thus, a time period in which a pressure pulsation reduction effect of the pulsation damper is applied to the fuel in the inner fuel chamber can be prolonged. The pressure pulsation transmitted to an outside member through the inlet opening can be restricted.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF EMBODIMENTS

[First Embodiment]

Figure 1:
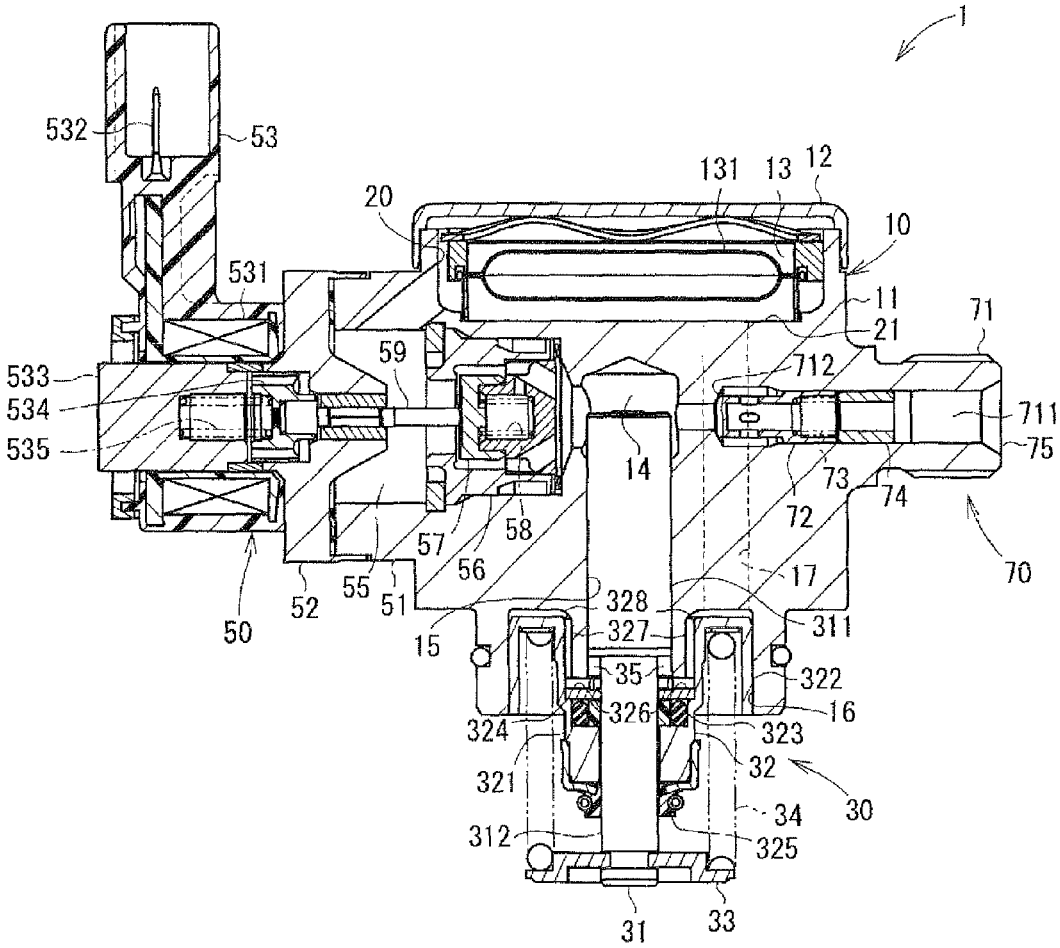
FIG. 1 is a cross sectional view showing a basic configuration of a high-pressure pump according to a first embodiment of the invention.

Hereafter, a first embodiment of the present invention will be described. A basic configuration of the high-pressure pump is explained first. The high-pressure pump compresses the fuel pumped up from a fuel tank by a low-pressure fuel pump and discharges the compressed fuel into a fuel rail. FIG. 1 is a cross sectional view showing a high-pressure pump 1. The high-pressure pump 1 compresses a fuel supplied from an inlet (not shown) and discharges the compressed fuel from a discharge valve portion 70 to a fuel rail (not shown). The inlet of the high-pressure pump 1 is fluidly connected to a low-pressure fuel pump (not shown) through a pipe. The high-pressure pump 1 is comprised of a pump body 10, a plunger portion 30, a suction valve portion 50 and the discharge valve portion 70.

The pump 10 is provided with a housing 11 which forms an outer profile of the high-pressure pump 1. A cover 12 is provided on the housing 11 to define a fuel gallery 13 therebetween. A pulsation damper 131 is arranged in the fuel gallery 13.

The plunger portion 30 is formed at an opposite side of the cover 12. A compression chamber 14 is defined in the housing 11 between the plunger portion 30 and the fuel gallery 13. The suction valve portion 50 and the discharge valve portion 70 are formed at left side and right side of the pump body 10 respectively. The fuel supplied to the fuel gallery 13 is introduced into the compression chamber 14 through the suction valve portion 50 and is discharged through the discharge valve portion 70.

Then, the configurations of the plunger portion 30, the suction valve portion 50, and the discharge valve portion 70 will be described in detail, hereinafter. First, the plunger portion 30 is described. The plunger portion 30 includes a plunger 31, an oil-seal holder 32, a spring seat 33 and a plunger-spring 34.

The plunger 31 has a large diameter portion 311 and a small diameter portion 312. The large diameter portion 311 is slidablly supported in a cylinder 15 which is formed in the housing 11. An outer diameter of the small diameter portion 312 is smaller than that of the large diameter portion 311.

The oil-seal holder 32 is arranged at an opening end of the cylinder 15 and has a base portion 321 surrounding the small diameter portion 312 of the plunger 31 and a press-insert portion 322 which is press-inserted into the housing 11. The base portion 321 has a ring-shaped seal 323 therein. The ring-shaped seal 323 is comprised of an inner seal member and an outer O-ring. A thickness of the fuel on the small diameter portion 312 is adjusted by the ring-shaped seal 323 to restrict a leakage of the fuel. A plunger stopper 324 is provided adjacent to the seal 323. The base portion 321 has an oil-seal 325 on its tip end. A thickness of the oil on the small diameter portion 312 is adjusted by the oil-seal 325 to restrict a leakage of the fuel.

The press-insert portion 322 cylindrically extends from the base portion 321. Meanwhile, the housing 11 has a concave portion 16 receiving the press-insert portion 321. Thereby, the oil-seal holder 32 is press-inserted into the housing 11 in such a manner that the press-insert portion 322 is press-fitted to an outer wall of the concave portion 16.

A tip end of the small diameter portion 312 is in contact with a tappet (not shown). The tappet is in contact with a cam (not shown) of a camshaft and reciprocates according to a cam profile of the cam. Thereby, the plunger 31 reciprocates in its axial direction.

One end of the plunger spring 34 is engaged with the spring seat 33 and the other end of the plunger spring 34 is engaged with the press-insert portion 322. The plunger spring 34 biases the plunger 31 downwardly so that the plunger 31 is in contact with the tappet.

The plunger 31 reciprocates along with a cam profile of a camshaft. According to a reciprocation of the large diameter portion 311 of the plunger 31, a volume of the compression chamber 14 is varied.

Moreover, a variable volume chamber 35 is defined around the small diameter portion 312 of the plunger 31. In the present embodiment, the variable volume chamber 35 is defined by the cylinder 15, a bottom end of the large diameter portion 311 of the plunger 31, an outer surface of the small diameter portion 312, and the seal 323 of the oil-seal holder 32. The seal 323 restricts a fuel leakage from the variable volume chamber 35 to the engine and an oil leakage from the engine into the variable volume chamber 35.

The variable volume chamber 35 is fluidly connected to the fuel gallery 13 through a fuel passage 326 formed in the plunger stopper 324, a cylindrical passage 327 formed between the press-insert portion 322 and the concave portion 16, an annular passage 328 formed at a bottom of the concave portion 16, and a return passage 17 formed in the housing 11 which is illustrated by dashed lines in FIG. 1.

Next, the suction valve portion 50 will be described in detail. As shown in FIG. 1, the suction valve portion 50 includes a cylindrical portion 51 of the housing 11, a valve cover 52 which covers an opening of the cylindrical portion 51, and a connector 53. The cylindrical portion 51 defines a fuel suction passage 55 therein. A cylindrical seat body 56 is provided in the fuel suction passage 55. The seat body 56 includes a suction valve 57 therein. The suction valve 57 accommodates a spring 58.

A needle 59 is in contact with the suction valve 57. This needle 59 penetrates the valve cover 52 and extends to an interior of the connector 53. The connector 53 has a coil 531 and a terminal 532 for energizing the coil 531. A fixed core 533, a movable core 534, and a spring 535 are disposed inside of the coil 531. The needle 59 is mechanically connected to the movable core 534. That is, the movable core 534 and the needle 59 slide together.

When the coil 531 is energized through the terminal 532, a magnetic attraction force is generated between the fixed core 533 and the movable core 534. The movable core 534 is attracted to the fixed core 533 along with the needle 59. Then, the suction valve 57 seats on the seat body 56 to disconnect the fuel suction passage 55 and the compression chamber 14.

Meanwhile, when the coil 531 is deenergized, the movable core 534 moves apart from the fixed core 533 by a biasing force of the spring 535. The needle 59 pushes the suction valve 57 so that the suction valve 57 is unseated from the seat body 56. As the result, the fuel suction passage 55 communicates with the compression chamber 14.

Next, the discharge valve portion 70 will be described in detail, hereinafter. The discharge valve portion 70 has a cylindrical accommodation portion 71 of the housing 11, as shown in FIG. 1. The accommodation portion 71 defines an accommodation chamber 711 in which a discharge valve 72, a spring 73 and an engaging member 74 are provided. An opening portion of the accommodation chamber 711 corresponds to a discharge port 75. A valve seat 712 is formed in the accommodation chamber 711.

The discharge valve 72 is biased to the valve seat 712 by the spring 73 and a fuel pressure from a fuel rail (not shown). While the fuel pressure in the compression chamber 14 is relatively low, the discharge valve 72 seats on the valve seat 712 so that no fuel is discharged from the discharge port 75. Meanwhile, when the fuel pressure in the compression chamber 14 exceeds the biasing force of the spring 73 and the fuel pressure from the fuel rail, the discharge valve 72 is unseated from the valve seat 712, so that the fuel in the compression chamber 14 is discharged from the discharge port 75.

Figure 2:
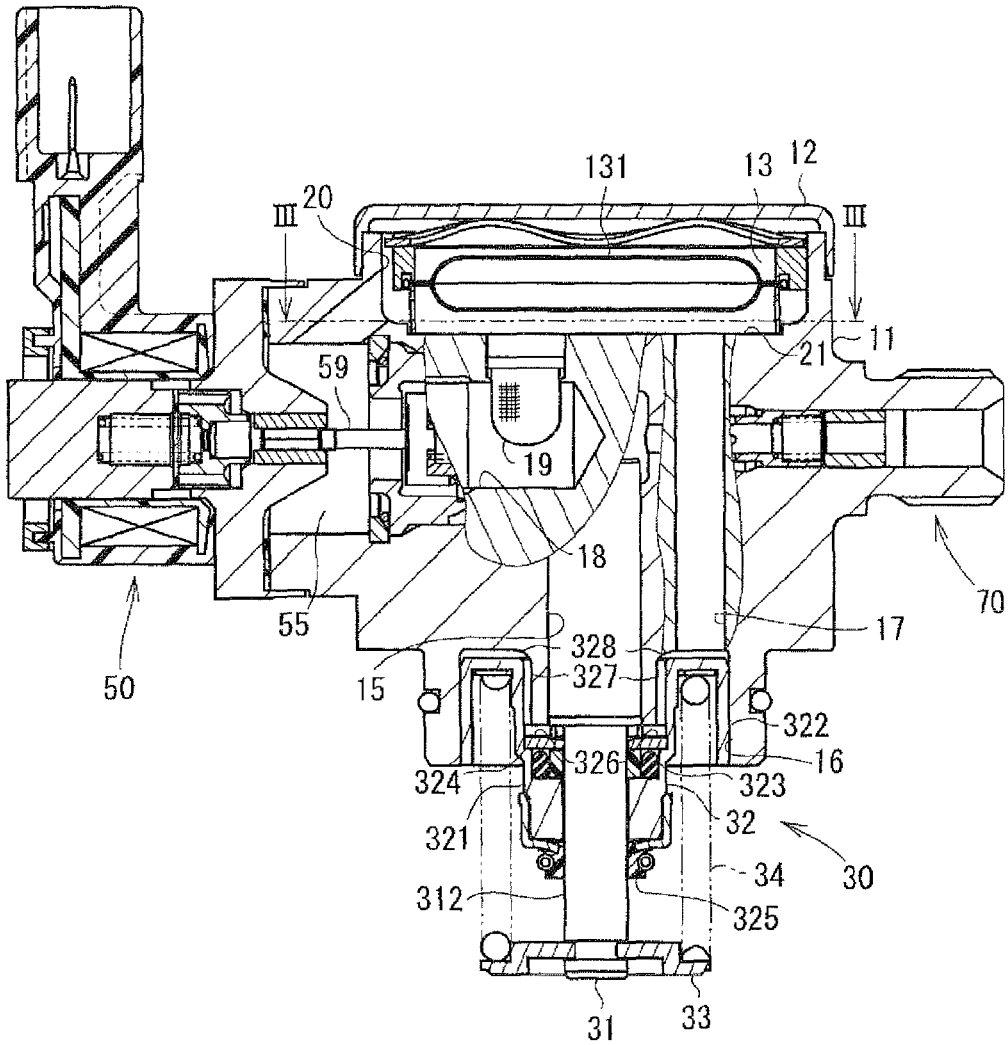
FIG. 2 is a cross sectional view showing a supply passage from an inlet and a return passage from a variable volume chamber.
Figure 3:
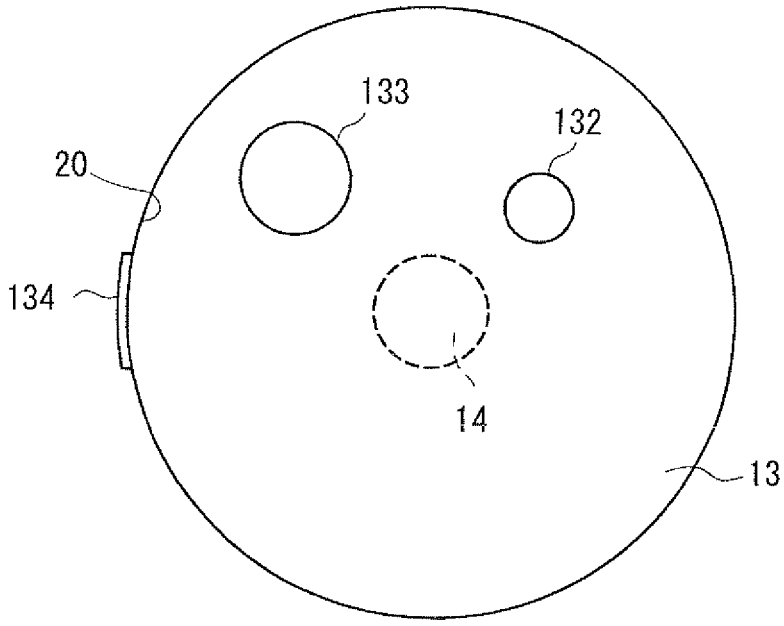
FIG. 3 is a view schematically showing a cross-sectional view taken along a line in FIG. 2.

Next, a fuel supply to the fuel gallery 13 will be described hereinafter. FIG. 2 is a cross sectional view with parts broken away for showing the return passage 17 from the variable volume chamber 35 and a supply passage 18 from an inlet. FIG. 3 is a view schematically showing a cross-sectional view taken along a line III-III in FIG. 2. FIG. 3 shows a part corresponding to only the fuel gallery 13.

As shown in FIG. 3, a volume chamber opening 132 and an inlet opening 133 are formed on a bottom surface of the fuel gallery 13 of the housing 11. The return passage 17 is connected to the volume chamber opening 132. The supply passage 18 is connected to the inlet opening 133. A filter 19 is disposed in the supply passage 18. According to the above configuration, the fuel supplied to the inlet from the low-pressure fuel pump is introduced into the fuel gallery 13. Further, the fuel gallery 13 has a suction opening 134. The fuel suctioned through the suction opening 134 is introduced into the compression chamber 14 through the suction valve portion 50.

Figure 4:
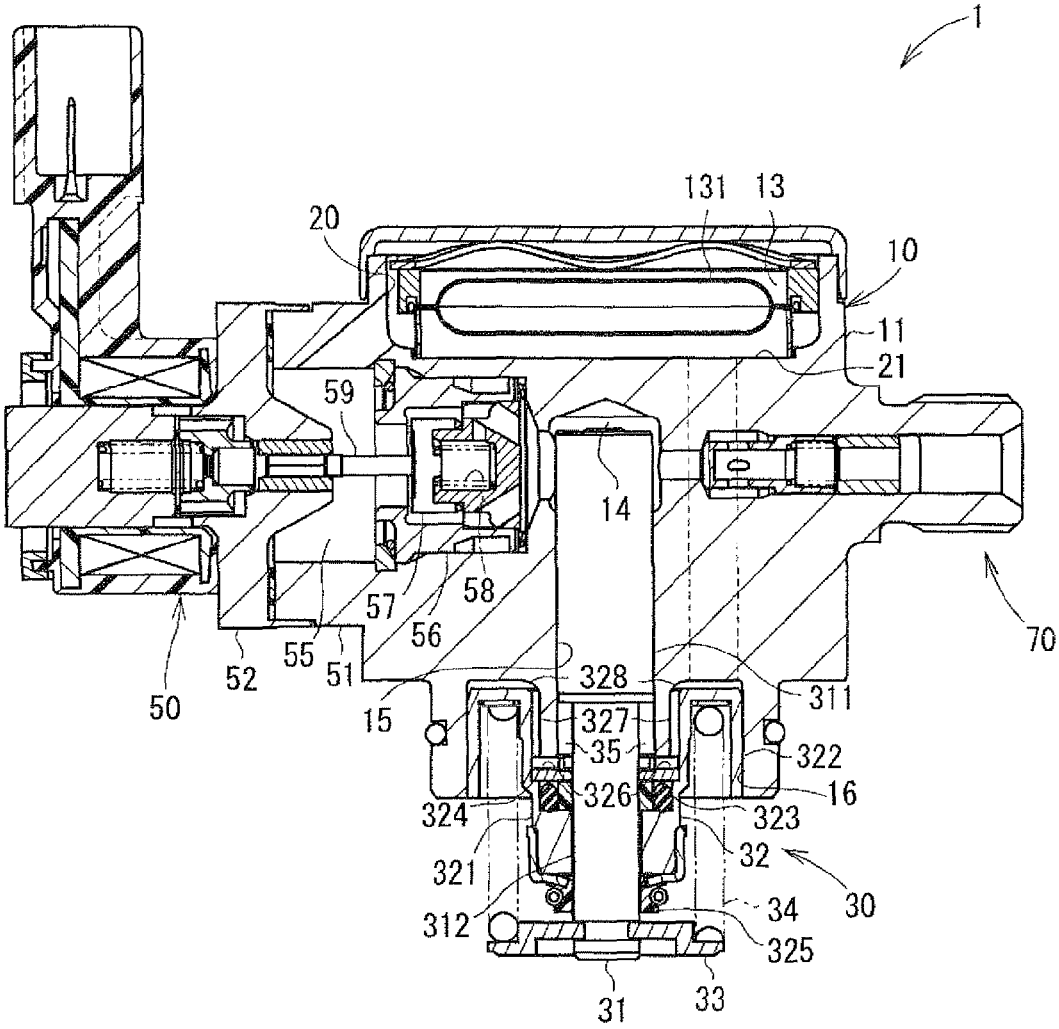
FIG. 4 is a cross sectional view showing a high-pressure pump of which plunger is at top dead center.
Figure 5:
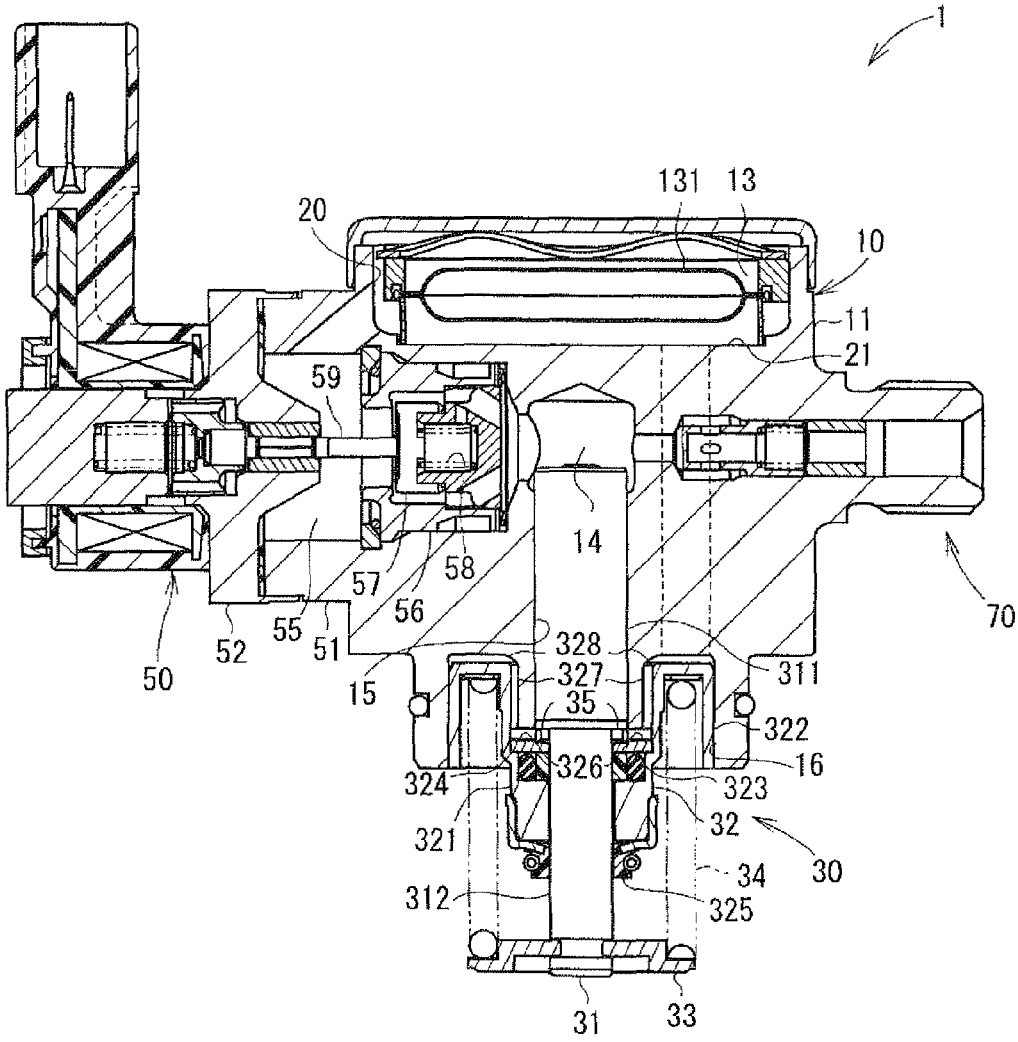
FIG. 5 is a cross sectional view showing a high-pressure pump of which plunger is at bottom dead center.

An operation of the high-pressure pump 1 will be described hereinafter. FIG. 4 is a cross sectional view of the high-pressure pump 1 of which plunger 31 is at a top dead center. FIG. 5 is a cross sectional view of the high-pressure pump 1 of which plunger is at a bottom end center.

The high-pressure pump 1 repeatedly performs the suction stroke, the metering stroke, and the compression stroke. In the suction stroke, the fuel is suctioned from the fuel gallery 13 to the compression chamber 14. The plunger 31 slides down from a top dead center (refer to FIG. 4) toward a bottom dead center (refer to FIG. 5) and the suction valve 57 is unseated.

In the metering stroke, the fuel is returned from the compression chamber 14 to the fuel gallery 13. The plunger 31 slides up from the bottom dead center (refer to FIG. 5) toward the top dead center (refer to FIG. 4) and the suction valve 57 is unseated. In the compression stroke, the fuel is discharged from the compression chamber 14 through the discharge valve portion 70. The plunger 31 slides up toward the top dead center (refer to FIG. 4) and the suction valve 57 is seated on the seat body 56. It should be noted that FIGS. 4 and 5 show a condition where the suction valve 57 is seated (closed).

A function of the variable volume chamber 35 will be described hereinafter. In the suction stroke, the plunger 31 slides down to increase the volume of the compression chamber 14. Meanwhile, a volume of the variable volume chamber 35 is decreased. Thus, the fuel stored in the variable volume chamber 35 is supplied to the fuel gallery 13. In the metering stroke, the plunger 31 slides up to reduce the volume of the compression chamber 14. The volume of the variable volume chamber 35 is increased. Therefore, a part of low-pressure fuel which is returned to the fuel gallery 13 from the compression chamber 14 is introduced into the variable volume chamber 35.

The variations in the volume of the variable volume chamber 35 and the compression chamber 14 are caused by a movement of the large diameter portion 311 of the plunger 31. During the compression stroke, the suction valve 57 is closed so that no fuel is returned to the fuel gallery 13 from the compression chamber 14.

The following advantages can be obtained by the function of the variable volume chamber 35. In the suction stroke, in a case that a decreased volume of the variable volume chamber 35 is "60", the fuel of "60" is supplied to the fuel gallery 13 from the variable volume chamber 35. When the volume of the compression chamber 14 is increased by "100", the required volume of the fuel supplied to the fuel gallery 13 through the inlet opening 133 is "40".

In the metering stroke, it is required to restrict a fuel pulsation. In a case that a decreased volume of the compression chamber 14 is "100", a fuel pulsation corresponding to "100" is generated. If this pulsation is transmitted to the supply passage 18 from the inlet opening 133, fuel pipes (not shown) may vibrate to make a noise. However, in a case that the increased volume of the variable volume chamber 35 is "60", the pulsation generated in the fuel gallery 13 can be restricted to "40".

Since the volume variation of the compression chamber 14 and the volume variation of the variable volume chamber 35 are generated at the same time, the above described advantage is always obtained without respect to the engine speed.

Furthermore, since the seal 323 and the oil seal 325 are provided around the small diameter portion 312, the sealing length becomes shorter than the case where the seals are provided around the large diameter portion 311.

By increasing the diameter of the large diameter portion 311, the discharge quantity can be increased.

In the present embodiment, the oil-seal holder 32 corresponds to a plunger surrounding portion of the present invention. The fuel passage 326, the cylindrical passage 327, the annular passage 328 and the return passage 17 correspond to a variable volume chamber passage of the present invention.

Next, while characteristic configuration of the high-pressure pump 1 is described, the advantages which the high-pressure pump 1 can achieve will be described hereinafter. In the high-pressure pump 1 described above, when the plunger 31 reciprocates at high speed, the fuel is introduced into the fuel gallery 13 through the volume chamber opening 132 with higher energy than through the inlet opening 133. The fuel supplied through the volume chamber opening 132 generates a large fuel flow in the fuel gallery 13.

A circumferential side wall 20 of the housing 11 defines a side edge of the fuel gallery 13. The fuel gallery 13 is a disc-shaped hollow space. The fuel in the fuel gallery 13 tends to flow transversely. In the present embodiment, the volume chamber opening 132 is formed at a bottom wall 21 of the fuel gallery 13 and the pulsation damper 131 is arranged above the volume chamber opening 132. Thus, the fuel discharged from the volume chamber opening 132 collides with the pulsation damper 131 and its flow direction is changed to transverse direction. The fuel flows transversely in the fuel gallery 13. In the present embodiment, as shown in FIG. 3, the suction opening 134 is provided to the circumferential side wall 20 of the fuel gallery 13 so that the fuel discharged from the volume chamber opening 132 easily flows into the suction opening 134. The fuel is efficiently suctioned into the compression chamber 14 during the suction stroke of the plunger 31.

Figure 6:
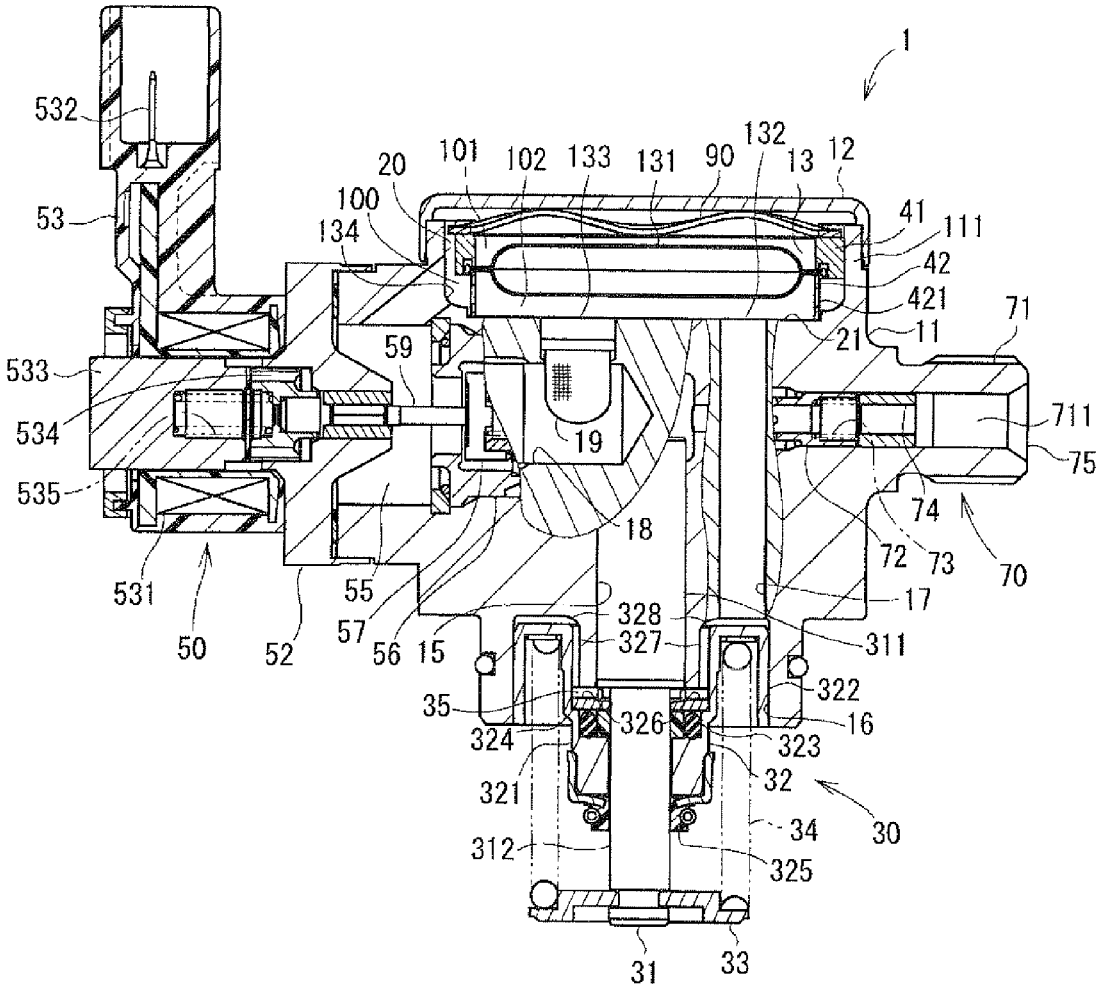
FIG. 6 is a cross-sectional view showing a high-pressure pump according to the first embodiment of the invention.
Figure 7:
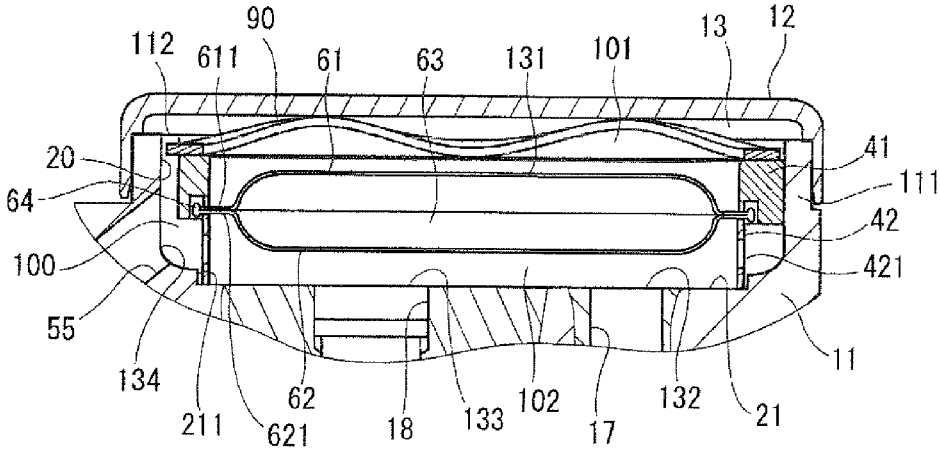
FIG. 7 is a fragmentally sectional view showing a high-pressure pump according to the first embodiment.

Referring to FIGS. 6 and 7, the configuration of the high-pressure pump 1 will be described more in detail. FIG. 6 is the same as FIG. 2, and FIG. 7 is an enlarged view of FIG. 6. The configuration of the fuel gallery 13, the fuel suction passage 55, the supply passage 18 and the return passage 17 will be described in detail.

The housing 11 has a cylindrical portion 111. The fuel gallery 13 is defined inside of the cylindrical portion 111. The cover 12 is welded to an outer periphery of the cylindrical portion 111. The suction opening 134 is formed at the circumferential wall 20 of the cylindrical portion 111. The volume chamber opening 132 and the inlet opening 133 are formed at the bottom wall 21.

In the fuel galley 13, the pulsation damper 131, a first supporting member 41, a second supporting member 42 and a wavy spring 90 are provided. The pulsation damper 131 is comprised of a first diaphragm 61 and a second diaphragm 62. The first and the second diaphragm 61, 62 are made of metal material and are formed to dish-shape by press working. An outer edge of a first peripheral edge portion 611 of the first diaphragm 61 and an outer edge of a second peripheral edge portion 621 of the second diaphragm 62 are welded to each other, which forms a welding portion 64. The first diaphragm 61 and the second diaphragm 62 are sealed air-tightly liquid-tightly to define a damper chamber 63 therebetween.

The damper chamber 63 is filled with helium (He), argon (Ar), or mixture thereof at a specified pressure. The first diaphragm 61 and the second diaphragm 62 are elastically deformed according to a variation in pressure in the fuel gallery 13. Thereby, the volume of the damper chamber 63 is varied to reduce the pressure pulsation of the fuel in the fuel gallery 13. A spring constant of the pulsation damper 131 is established based on thickness and material of the first and second diaphragms 61, 62, pressure of gas filling the damper chamber 63 and the like. A pulsation frequency which the pulsation damper 131 reduces depends on this spring constant.

The pulsation damper 131 is supported in the fuel gallery 13 by the first supporting member 41 and the second supporting member 42, which are formed annularly. The first supporting member 41 is provided between the pulsation damper 131 and the cover 12. The first supporting member 41 has an annular groove with which the welding portion 64 is engaged. The wavy spring 90 is provided between the first supporting member 41 and the cover 12 in such a manner that the first supporting member 41 is biased toward the first peripheral edge portion 611 of the pulsation damper 131. As above, the first supporting member 41 supports the first peripheral edge portion 611.

The second supporting member 42 is provided between the pulsation damper 131 and the bottom wall 21. One end of the second supporting member 42 is engaged with the welding portion 64. The other end of the second supporting member 42 is engaged with a step portion 211. As above, the second supporting member 42 supports the second peripheral edge portion 621 of the pulsation damper 131. The pulsation damper 131 is sandwiched between the first supporting member 41 and the second supporting member 42, whereby a relative displacement in radial direction between the pulsation damper 131, the first supporting member 41 and the second supporting member 42 is restricted. An outer fuel chamber 100 is defined at outer side of the first supporting member 41 and the second supporting member 42.

The outer fuel chamber 100 communicates with a first inner fuel chamber 101 through a radial clearance gap of the wavy spring 90. The first inner fuel chamber 101 is defined at radially inner side of the first supporting member 41. A second inner fuel chamber 102 is defined at radially inner side of the second supporting member 102. The outer fuel chamber 100 communicates with the second inner fuel chamber 102 through a plurality of apertures 421 which penetrate the second supporting member 42. A fuel flow between the outer fuel chamber 100 and the second inner fuel chamber 102 is restricted by positions, numbers, and opening area of the apertures 421.

The return passage 17 connecting the volume chamber opening 132 and the variable volume chamber 35 extends in parallel with the plunger 31. The suction opening 134 fluidly connects the outer fuel chamber 100 and the fuel suction passage 55. The suction opening 134 confronts to the first supporting member 41 and the wavy spring 90.

In the metering stroke of the high-pressure pump 1, the low-pressure fuel discharged from the suction opening 134 into the outer fuel chamber 100 flows through the radial clearance gap of the wavy spring 90 to be introduced into the first inner fuel chamber 101. The pressure pulsation of the fuel in the first inner fuel chamber 101 is attenuated by the first diaphragm 61 of the pulsation damper 131.

A flow velocity of the fuel flowing into the second inner fuel chamber 102 from the outer fuel chamber 100 is decreased by the apertures 421 when flowing through the apertures 421. The pressure pulsation of the fuel in the second inner fuel chamber 102 is attenuated by the second diaphragm 62 of the pulsation damper 131.

When the fuel is discharged from the suction opening 134 to the outer fuel chamber 100, the fuel is suctioned from the second inner fuel chamber 102 into the variable volume chamber 35. Meanwhile, when the fuel is suctioned form the outer fuel chamber 100 into the compression chamber 14, the fuel in the variable volume chamber 35 is discharged into the second inner fuel chamber 102. Since about 60% of the fuel discharged from the compression chamber 14 into the fuel gallery 13 is introduced into the variable volume chamber 35, the pressure pulsation transmitted from the inlet opening 133 to the low-pressure fuel pipe can be reduced. The pressure pulsation of the fuel discharged from the volume chamber opening 132 into the second inner fuel chamber 102 is attenuated by the second diaphragm 62 of the pulsation damper 131.

[Second Embodiment]

Figure 8:
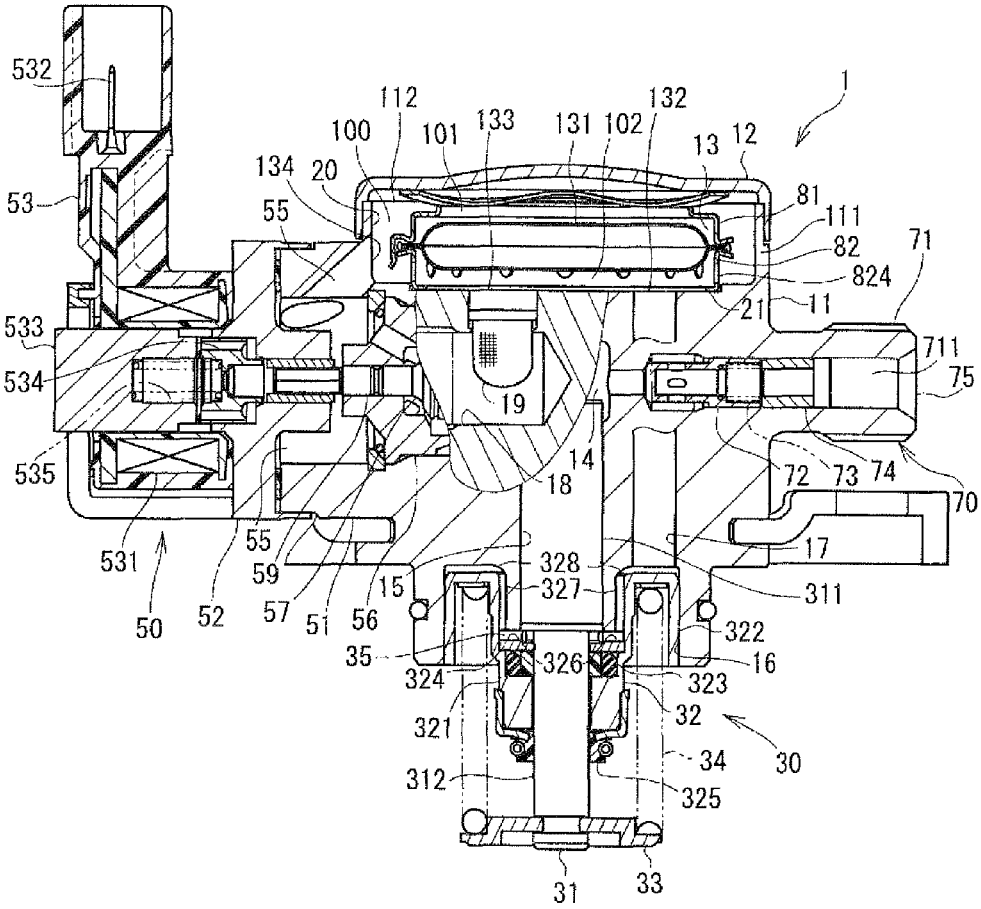
FIG. 8 is a cross-sectional view showing a high-pressure pump according to a second embodiment of the invention.
Figure 9:
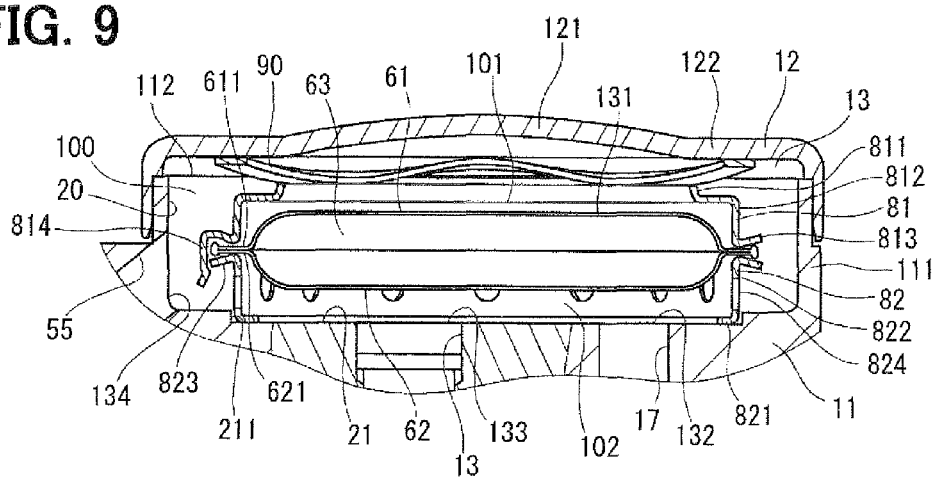
FIG. 9 is a fragmentally sectional view showing a high-pressure pump according to the second embodiment.

Referring to FIGS. 8 and 9, a second embodiment of the invention will be described. In the second and the successive embodiments, the same parts and components as those in the first and the second embodiments are indicated with the same reference numerals and the same descriptions will not be reiterated. In the second embodiment, the outer fuel chamber 100 having a large volume is defined around the first supporting member 81 and the second supporting member 82. The cover 12 is shaped to a dome having a convex portion 121 at its center part, so that a volume of the first inner fuel chamber 101 is increased.

The first supporting member 81 is comprised of an annular supporting portion 811, a first cylindrical portion 812, a first flange portion 813 and a first pawl portion 814. The annular supporting portion 811 integrally extends from the first cylindrical portion 812 radially inward. The annular supporting portion 811 supports a bottom surface of the wavy spring 90. The first flange portion 813 integrally extends from another end of the first cylindrical portion radially outward to support the first peripheral edge portion 611 of the pulsation damper 131.

The second supporting member 82 is comprised of a second small-diameter portion 821, a second cylindrical portion 822 and a second flange portion 823. The second cylindrical portion 822 is provided with a plurality of apertures 824 which penetrate the second cylindrical portion 822. The second flange portion 823 extends radially outward from the second cylindrical portion 822 and supports the second peripheral edge portion 621 of the pulsation damper 131. The second small-diameter portion 821 extends from the second cylindrical portion 822 radially inward to be engaged with the step portion 211.

The first pawl portion 814 extending from the first flange portion 813 is engaged with the second flange portion 823 of the second supporting member 82, whereby the first supporting member 81 and the second supporting member 82 are engaged with each other while clamping the pulsation damper 131 therebetween. With this configuration, a relative displacement in radial direction between the wavy spring 90, the first supporting member 81, the second supporting member 82 and the pulsation damper 131 is restricted. The outer fuel chamber 100 is defined at outer side of the first supporting member 81 and the second supporting member 82. Since the outer periphery end of the wavy spring 90 is free end, the outer fuel chamber 100 can be formed around the wavy spring 90. That is, the volume of the outer fuel chamber 100 is increased relative to the first embodiment.

The cover 12 has the convex portion 121 and the flat portion 122. The volume of the fuel gallery 13 can be increased by a volume corresponding to the convex portion 121. The fuel discharged from the suction opening 134 flows along an inner surface of the convex portion 121 so that the fuel flows toward the first diaphragm 61 to reduce the pressure pulsation.

According to the present embodiment, during the metering stroke, the low-pressure fuel discharged from the suction opening 134 into the outer fuel chamber 100 collides with the first supporting member 81, so that kinetic energy of the fuel is decreased and its flow velocity is reduced. Then, the mainstream of the low-pressure fuel is divided into the right and left of the first supporting member 81. The fuel flowing in the outer fuel chamber 100 further loses its energy and its flow velocity. The fuel flows into the first inner fuel chamber 101 from the outer fuel chamber 100 and its pressure pulsation is attenuated by the first diaphragm 61 of the pulsation damper 131. A flow velocity of the fuel flowing into the second inner fuel chamber 102 from the outer fuel chamber 100 is decreased by the apertures 421 when flowing through the apertures 421. The pressure pulsation of the fuel in the second inner fuel chamber 102 is attenuated by the second diaphragm 62 of the pulsation damper 131. Thus, the pressure pulsation transmitted from the inlet to the low-pressure pipe (not shown) can be restricted.

About 60% of the fuel discharged from the compression chamber 14 into the fuel gallery 13 is introduced into the variable volume chamber 35, and an outflow of the fuel from the inlet opening 133 to the inlet can be restricted. Since the volume chamber opening 132 communicates with the second inner fuel chamber 102, the pressure pulsation of the fuel flowing through the volume chamber opening 132 is attenuated by the second diaphragm 62 of the pulsation damper 131.

[Third Embodiment]

Figure 10:
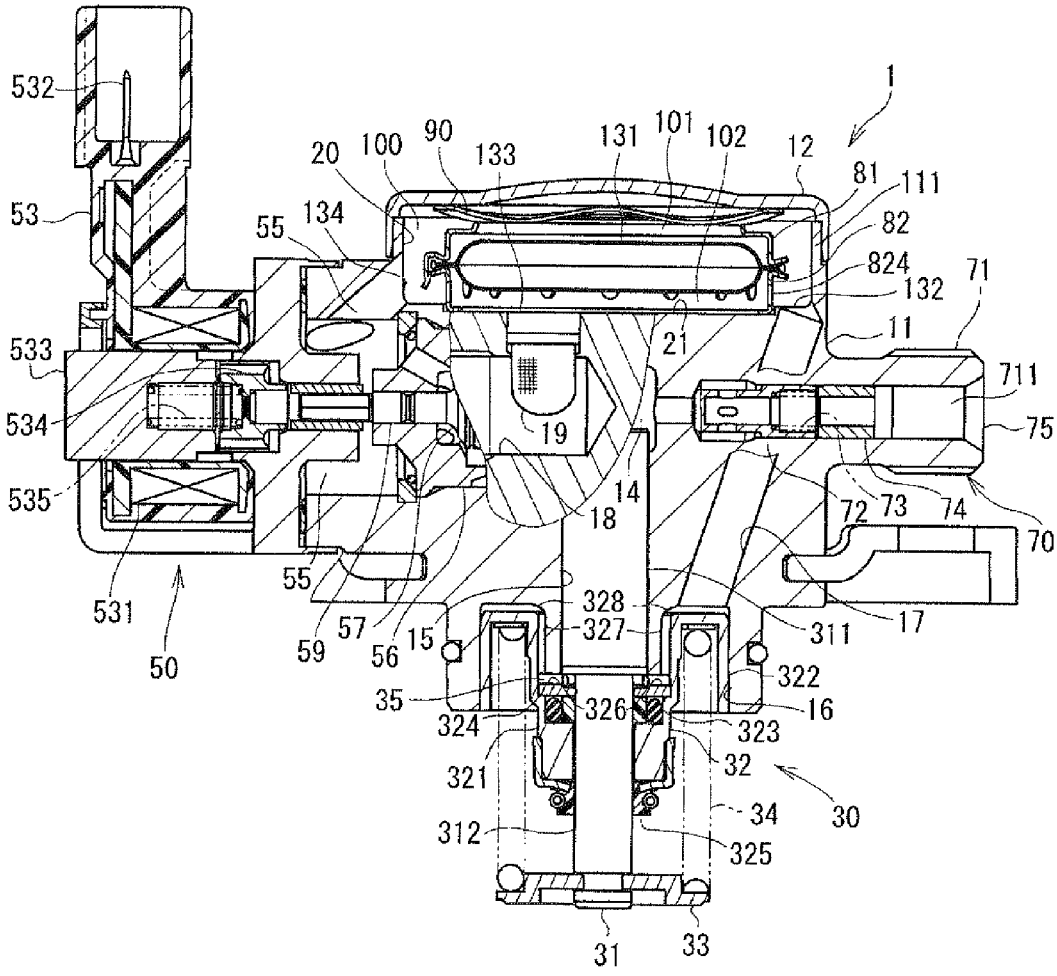
FIG. 10 is a cross-sectional view showing a high-pressure pump according to a third embodiment of the invention.

Referring to FIG. 10, a third embodiment of the invention will be described. According to the third embodiment, the suction opening 134 is formed at the circumferential wall 20 and the inlet opening 132 is formed at the bottom wall 21 radially outside of the second supporting member 82. The inlet opening 133 is formed at the bottom wall 21 radially inside of the second supporting member 82.

In the metering stroke of the high-pressure pump 1, the low-pressure fuel discharged from the suction opening 134 into the outer fuel chamber 100 flows around in the outer fuel chamber 100. The flow velocity of the fuel is gradually decreased. About 60% of the fuel is suctioned into the variable volume chamber 35 through the volume chamber opening 132. The pressure pulsation of the fuel introduced into the first inner fuel chamber 101 from the outer fuel chamber 100 is attenuated by the first diaphragm 61 of the pulsation damper 131. The flow velocity of the fuel flowing into the second inner fuel chamber 102 from the outer fuel chamber 100 is further decreased when passing through the apertures 421. The pressure pulsation is surely attenuated by the second diaphragm 62. Thus, the pressure pulsation transmitted from the inlet to the low-pressure pipe (not shown) can be restricted.

[Fourth Embodiment]

Figure 11:
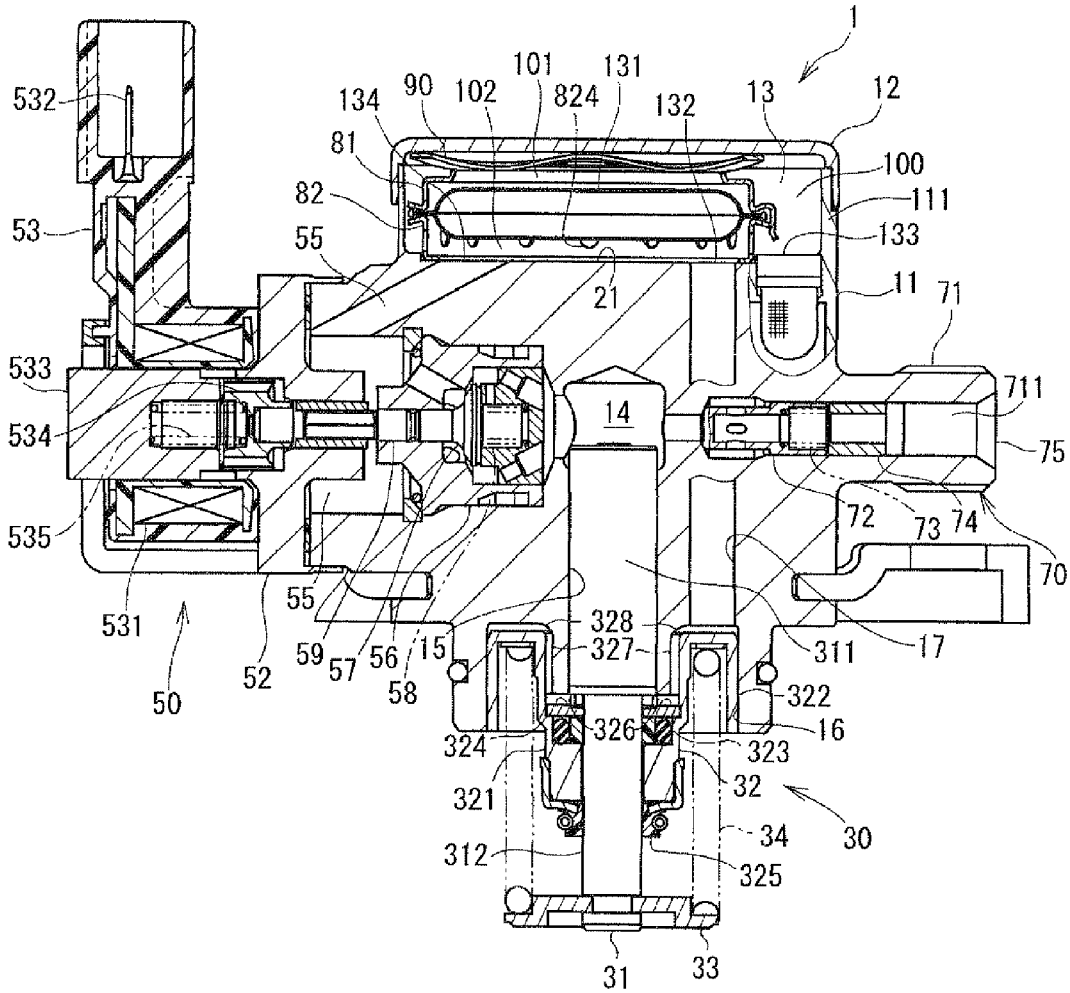
FIG. 11 is a cross-sectional view showing a high-pressure pump according to a fourth embodiment of the invention.

Referring to FIG. 11, a fourth embodiment of the invention will be described. The suction opening 134 and the volume chamber opening 132 are formed at the bottom wall 21 radially inside of the second supporting member 82. The inlet opening 133 is formed at the bottom wall 21 radially outside of the second supporting member 82.

In the metering stroke of the high-pressure pump 1, the pressure pulsation of the low-pressure fuel discharged from the suction opening 134 into the second inner fuel chamber 102 is attenuated by the second diaphragm 62 of the pulsation damper 131. About 60% of the low-pressure fuel is suctioned into the variable volume chamber 35 through the volume chamber opening 132. The fuel flowing out from the second inner fuel chamber 102 into the outer fuel chamber 100 is restricted by the apertures 421 so that its flow velocity is decreased. The pressure pulsation of the fuel introduced into the first inner fuel chamber 101 from the outer fuel chamber 100 is attenuated by the first diaphragm 61 of the pulsation damper 131. Thus, the pressure pulsation transmitted from the inlet to the low-pressure pipe (not shown) can be restricted.

[Fifth Embodiment]

Figure 12:
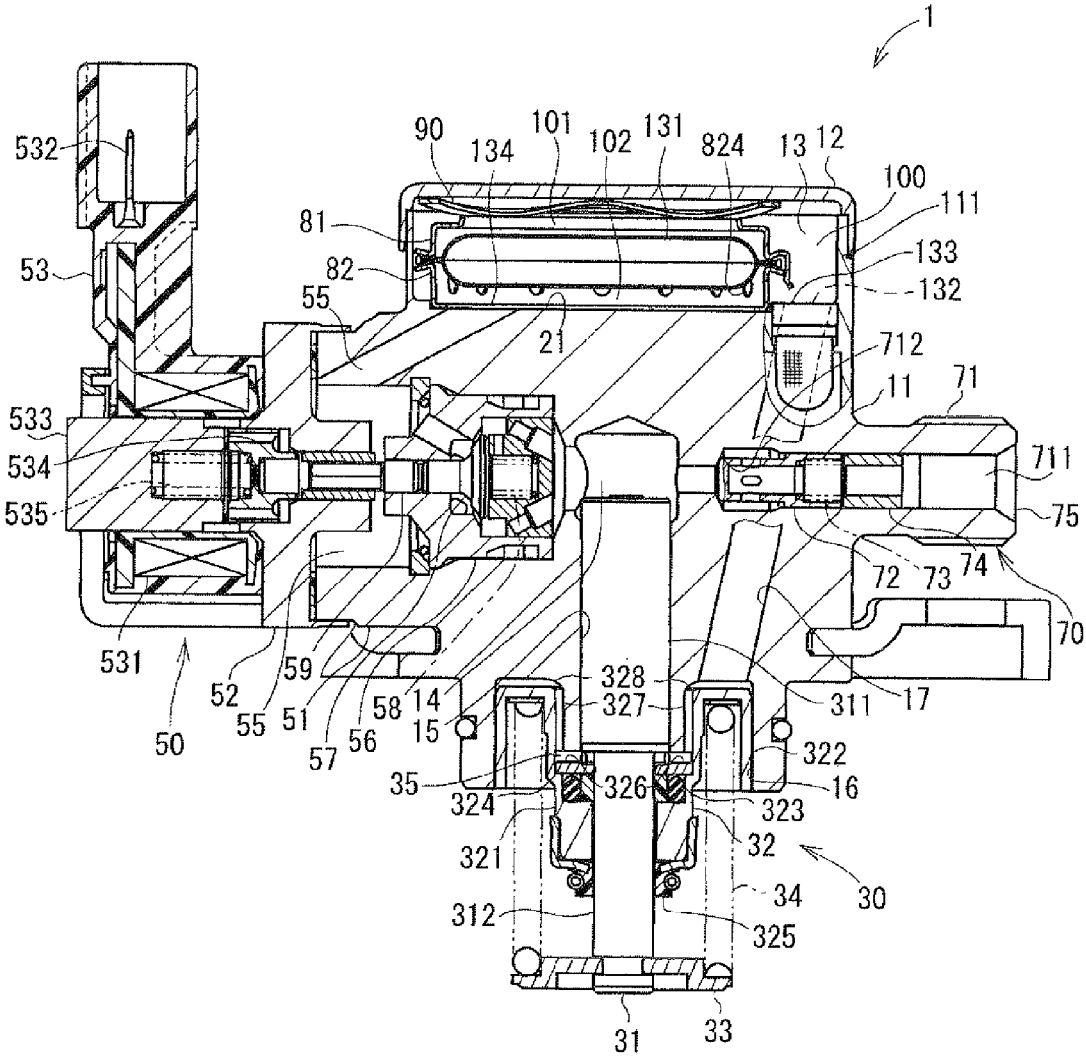
FIG. 12 is a cross-sectional view showing a high-pressure pump according to a fifth embodiment of the invention.

Referring to FIG. 12, a fifth embodiment of the invention will be described. According to the present embodiment, the suction opening 134 is formed at the bottom wall 21 radially inside of the second supporting member 82. The volume chamber opening 132 and the inlet opening 133 are formed at the bottom wall 21 radially outside of the second supporting member 82.

In the metering stroke of the high-pressure pump 1, the pressure pulsation of the low-pressure fuel discharged from the suction opening 134 into the second inner fuel chamber 102 is attenuated by the second diaphragm 62 of the pulsation damper 131. The fuel flowing out from the second inner fuel chamber 102 into the outer fuel chamber 100 is restricted by the apertures 421 so that its flow velocity is decreased. Further, about 60% of the low-pressure fuel discharged into the fuel gallery 13 from the compression chamber 14 is suctioned into the variable volume chamber 35 through the volume chamber opening 132. The pressure pulsation of the fuel introduced into the first inner fuel chamber 101 from the outer fuel chamber 100 is attenuated by the first diaphragm 61 of the pulsation damper 131. Thus, the pressure pulsation transmitted from the inlet to the low-pressure pipe (not shown) can be restricted.

The pressure pulsation of the low-pressure fuel discharged from the suction opening 134 into the second inner fuel chamber 102 is attenuated by the second diaphragm 62 of the pulsation damper 131. The pressure pulsation of the fuel flowing through the volume chamber opening 132 is attenuated by the first diaphragm 61 of the pulsation damper 131.

[Other Embodiment]

In the first embodiment, the flow direction of the fuel discharged from the volume chamber opening 132 into the fuel gallery 13 is varied by the pulsation damper 131. In terms of this, a flow direction of the fuel in the fuel gallery 13 may be changed by a baffle plate (not shown) arranged in the fuel gallery 13. The fuel flows transversely in the fuel gallery 13 so that the fuel is effectively suctioned into the compression chamber 14 during the suction stroke of the plunger 31.

In the above embodiments, the outer fuel chamber 100 communicates with the second inner fuel chamber 102 through the apertures 421. Instead of the apertures 421, the outer fuel chamber 100 may communicate with the second inner fuel chamber 102 through a groove (not shown) provided to the bottom wall 21 of the housing 11. The present invention is not limited to the embodiments mentioned above, and can be applied to various embodiments.

What is claimed is:

1. A high-pressure pump comprising:

a housing defining a compression chamber and a fuel gallery therein, the compression chamber having a discharge port through which a fuel is discharged therefrom, the fuel gallery having an inlet opening through which the fuel flows thereinto, the fuel gallery having a suction opening communicating with the compression chamber;

a plunger slidably arranged in the compression chamber and varying a volume of the compression chamber in order to suction the fuel into the compression chamber or to discharge the fuel from the compression chamber;

a suction valve provided in a fuel suction passage fluidly connecting the compression chamber and the fuel gallery, the suction valve discharging a part of the fuel in the compression chamber into the fuel gallery through the suction opening to adjust a quantity of fuel which is discharged from the discharge port when the plunger slides up to reduce the volume of the compression chamber;

a damper provided in the fuel gallery for attenuating a pressure pulsation of the fuel in the fuel gallery, the damper comprised of a first diaphragm and a second diaphragm which respectively have a first peripheral edge portion and a second peripheral edge portion, the first peripheral edge portion and the second peripheral edge portion being joined together in order to form a damper chamber in the damper;

an annular first supporting member supporting the first peripheral edge portion of the first diaphragm, the first supporting member defining a first inner fuel chamber radially inside; and an annular second supporting member supporting the second peripheral edge portion of the second diaphragm, the annular second supporting member defining a second inner fuel chamber radially inside, wherein:

the first supporting member and the second supporting member define an outer fuel chamber radially outside thereof, the second inner fuel chamber and the outer fuel chamber communicate with each other through a restriction, one of the inlet opening and the suction opening is located to confront the outer fuel chamber, and the other of the inlet opening and the suction opening is located to confront the second inner fuel chamber, the restriction is a plurality of apertures which penetrates the second supporting member to communicate the outer fuel chamber with the second inner fuel chamber, the apertures are arranged circumferentially along the annular second supporting member, and an opening area of the apertures is smaller than that of the suction opening so that a flow velocity of the fuel flowing into the second inner fuel chamber from the outer fuel chamber is decreased by the apertures when flowing through the apertures, and wherein:

the plunger includes a large diameter portion, and a small diameter portion, and a plunger surrounding portion which defines a variable volume chamber around the small diameter portion, in a case that the volume of the compression chamber is decreased, a volume of the variable volume chamber is increased so that the fuel is introduced into the variable volume chamber from the fuel gallery through a variable volume chamber passage, in a case that the volume of the compression chamber is increased, the volume of the variable volume chamber is decreased so that the fuel is introduced into the fuel gallery from the variable volume chamber fuel gallery through the variable volume chamber passage, and a volume chamber opening of the variable volume chamber passage opens at the fuel gallery radially outside of the second supporting member.

2. A high-pressure pump according to claim 1, wherein the outer fuel chamber is defined radially outside of the first supporting member and the second supporting member along an entire axis line thereof.

3. A high-pressure pump according to claim 1, wherein the outer fuel chamber is defined along an entire circumferential outer surface of the first supporting member and the second supporting member.

4. A high-pressure pump according to claim 1, wherein the first inner fuel chamber communicates with the outer fuel chamber.

5. A high-pressure pump according to claim 1, wherein the suction opening is located radially outside of the second supporting member, and the fuel suction passage fluidly connecting the suction opening and the compression chamber is formed in such a manner that the fuel discharged from the suction opening into the outer fuel chamber flows in a direction toward the first supporting member or the damper which biases the first supporting member to the first peripheral edge portion of the first diaphragm.

* * * * *

UNITED STATES PATENT AND TRADEMARK OFFICE

CERTIFICATE OF CORRECTION

PATENT NO. : 8,430,655 B2
APPLICATION NO. : 12/841424
DATED : April 30, 2013
INVENTOR(S) : Kobayashi et al.

It is certified that error appears in the above-identified patent and that said Letters Patent is hereby corrected as shown below:

On the Title page, Item [75], please correct "Ogari" to --Oguri--.

Signed and Sealed this
Twenty-seventh Day of August, 2013

Teresa Stanek Rea
*Acting Director of the United States Patent and Trademark Office*